United States Patent [19]

Webb

[11] 4,365,562

[45] Dec. 28, 1982

[54] SUPPORT ASSEMBLY

[75] Inventor: William M. Webb, Louisville, Ky.

[73] Assignee: General Electric Company, Louisville, Ky.

[21] Appl. No.: 193,683

[22] Filed: Oct. 3, 1980

[51] Int. Cl.[3] ..... A47B 9/00

[52] U.S. Cl. ..... 108/108; 108/152

[58] Field of Search ..... 108/108, 109, 107, 96, 108/152; 211/153

[56] References Cited

U.S. PATENT DOCUMENTS

| | | | |
|---|---|---|---|
| 775,498 | 11/1904 | Parsons et al. | 108/108 |
| 2,002,328 | 5/1935 | Mitchell | 108/152 X |
| 2,308,330 | 1/1943 | Harbison | 211/153 |
| 3,067,882 | 12/1962 | Ribbens et al. | 108/108 |
| 3,097,746 | 7/1963 | Handler et al. | 108/108 X |
| 3,196,812 | 7/1965 | Jacques | 108/108 |
| 3,216,377 | 11/1965 | Gunn | 108/108 |
| 3,538,860 | 11/1970 | Fisher | 108/152 |
| 3,598,066 | 8/1971 | Polezoes | 108/108 |
| 3,614,044 | 10/1971 | Bard | 108/108 |

OTHER PUBLICATIONS

*Popular Mechanics,* Oct. 1964, p. 176.

*Primary Examiner*—Francis K. Zugel
*Attorney, Agent, or Firm*—Frederick P. Weidner; Radford M. Reams

[57] ABSTRACT

A support assembly for an inside corner formed by a vertical rear wall and a vertical side wall intersecting each other at a right angle. The support assembly includes an elongated vertical track secured to one of the walls in close proximity to the inside corner. A shelf assembly is secured to the track and includes a bracket having a forward portion and a rearward portion, said rearward portion having means for removable securement to the track. The shelf assembly also includes a support member having a forward portion and a rearward portion and horizontally spaced from the bracket and a planer shelf is supported by the bracket and support member. The shelf assembly has a torsion member extending between and at right angles to both the bracket and support member and secured to each. By this support assembly, the shelf assembly may be supported on a single track.

9 Claims, 4 Drawing Figures

SUPPORT ASSEMBLY

BACKGROUND OF THE INVENTION

The present invention relates to a support assembly and more particularly to a cantilever support assembly for use as a shelf in refrigerators.

The fresh food storage compartment of a refrigerator normally includes a number of vertically spaced shelves which are movably supported on elongated ladder tracks fastened to the liner of the compartment. In many refrigerators, it is desirable to have half shelves, that is, shelves that only extend partially across the width of the compartment. These half shelves are advantageous in that they may be moved up or down the tracks to accommodate tall items, such as tall bottles, to be stored in the refrigerator. While the full width shelves are suppoorted on tracks located at the rear corners of the compartment, in order to support the half shelves it is necessary that a central vertical track also be included so that the one end of the half shelf may be supported thereon in the middle of the refrigerator.

By the present invention, there is provided a support assembly including a half shelf that does not require the central vertical track for support of the shelf.

SUMMARY OF THE INVENTION

In accordance with the present invention, there is provided a support assembly for an inside corner formed by a vertical rear wall and a vertical side wall intersecting each other at a right angle. The support assembly includes an elongated vertical track secured to one of the walls in close proximity to the inside corner and there is a shelf assembly for securement to the track. The shelf assembly includes a bracket having a forward and a rearward portion, said rearwood portion having means for removable securement to the track. The shelf assembly also includes a support member having a forward portion and a rearward portion and horizontally spaced from the bracket. A planer shelf is supported by the bracket and support member. A torsion member extends between and at a right angle to both the bracket and support member and is secured to each to provide structural rigidity to the shelf assembly.

DESCRIPTION OF THE PREFERRED EMBODIMENT

Figure 1:
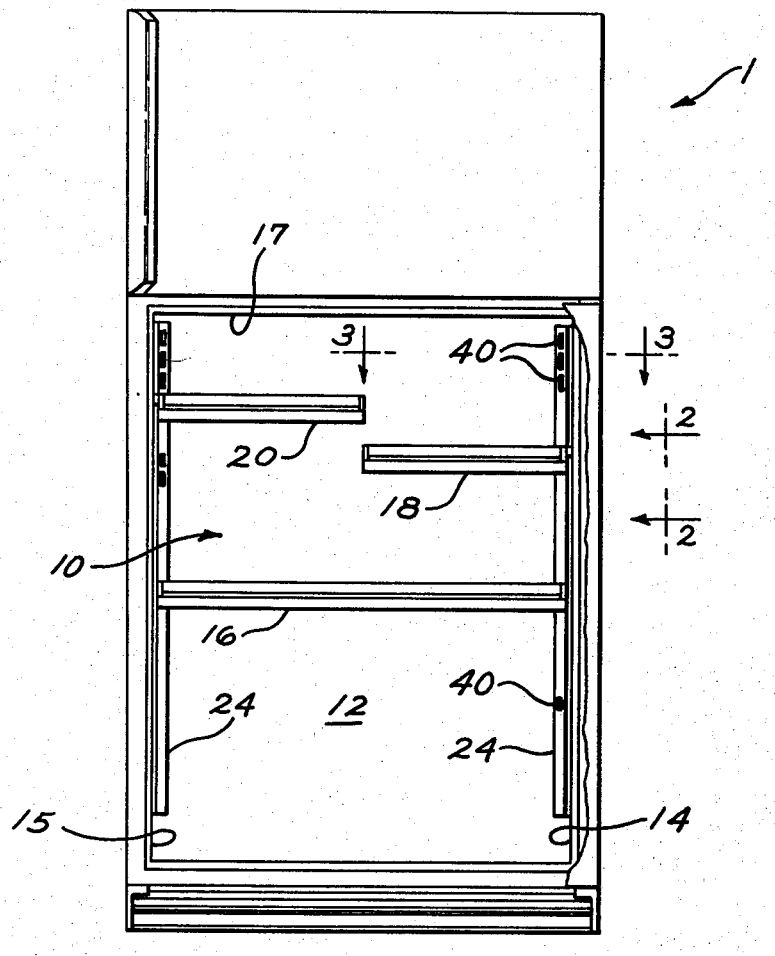
FIG. 1 is a front elevational view of a household refrigerator showing one embodiment of the support assembly of the present invention.
Figure 2:
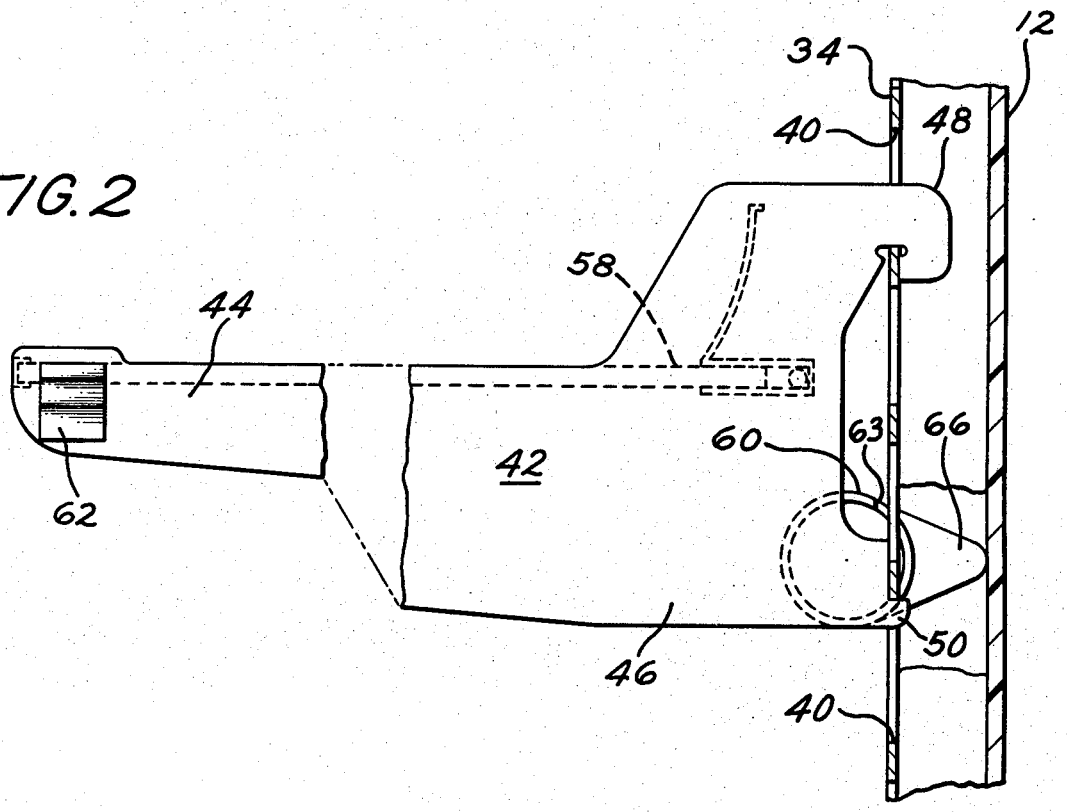
FIG. 2 is a fragmented view taken along lines 2-2 of FIG. 1 with parts broken away.

Referring to FIG. 1, there is shown a refrigerator cabinet 1, including a fresh food storage compartment 10, defined by a rear wall 12 and spaced from side walls 14 and 15; the compartment having an access opening 17 at the front thereof closed by a door, not shown.

Compartment 10 contains a pluraltiy of vertically spaced full width storage shelves such as the single shelf 16 shown, and also some half shelves such as the two half shelves 18 and 20. The half shelves may be supported in the same plane or at different planes as shown in FIG. 1. The full width shelf 16 occupies substantially the entire horizontal cross sectional area of the comaprtment 10. The half shelves 18 and 20 each substantially occupy half of the horizontal cross sectional area of the compartment. For this reason, they are commonly referred to in the trade as half shelves. The shelves 16, 18 and 20 are of generally rectangular configuration.

It is desirable that the shelves of a refrigerator be vertically adjustable in order to provide spacing of the shelves as desired by the user. In order to provide means by which the user may quickly select the desired vertical position of the shelves, there is, as shown in FIG. 1, vertically elongated tracks to which the shelves are movably secured. In the preferred embodiment of the present invention, there are only two spaced parallel elongated rigid tracks 24 secured either to the rear wall 12 or the side walls 14 or 15 in close proximity to the inside corner formed by the vertical rear wall 12 and either the vertical side wall 14 or 15 which intersect each other at a right angle. The tracks 24 are made of rigid material to withstand the weight of the shelves and the articles stored thereon and they are attached to the liner of compartment 10 by any suitable means which usually are headed attachment elements of screws 38.

Figure 3:
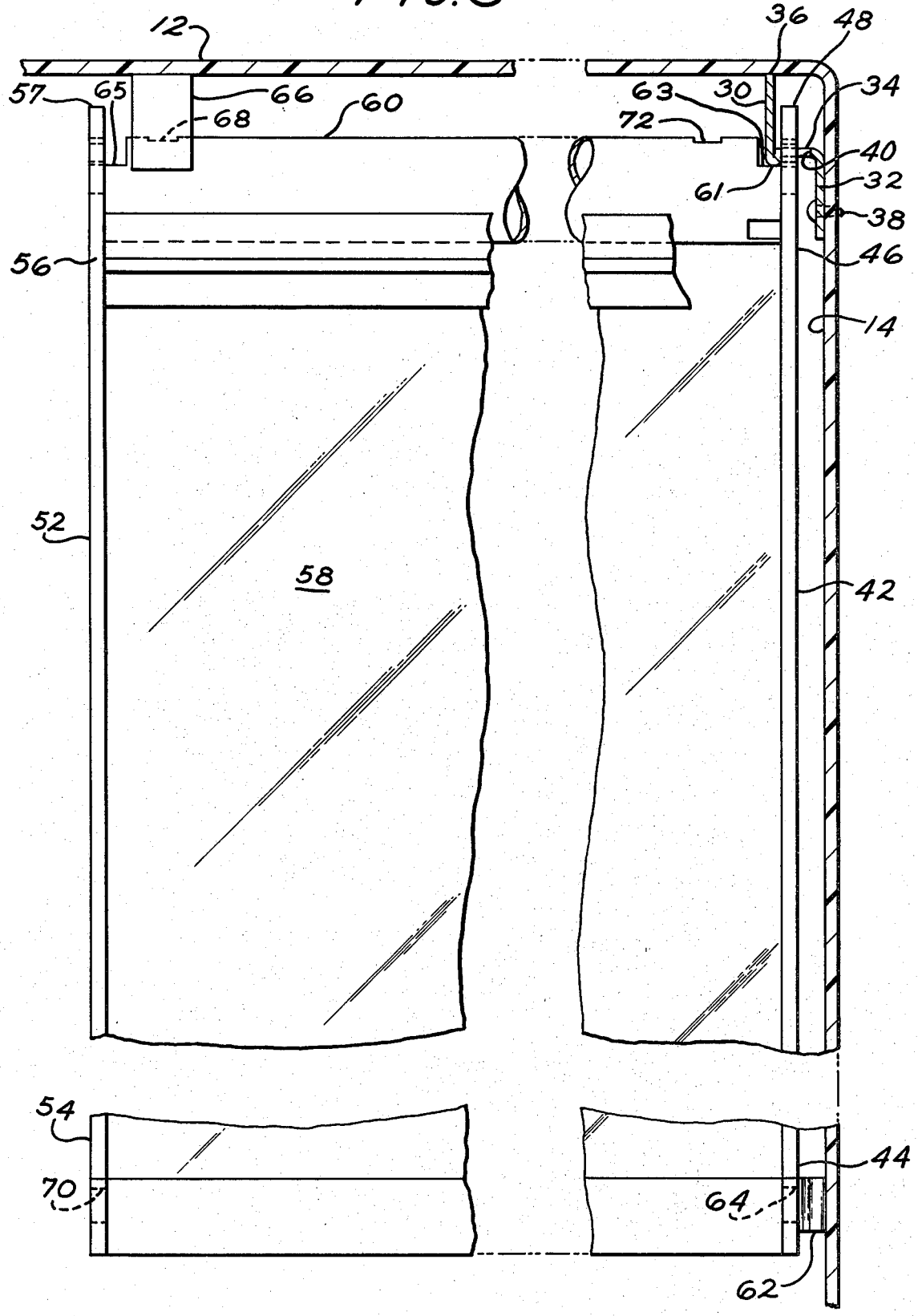
FIG. 3 is a fragmented view of the support assembly of one embodiment of the present invention taken along lines 3-3 of FIG. 1.
Figure 4:
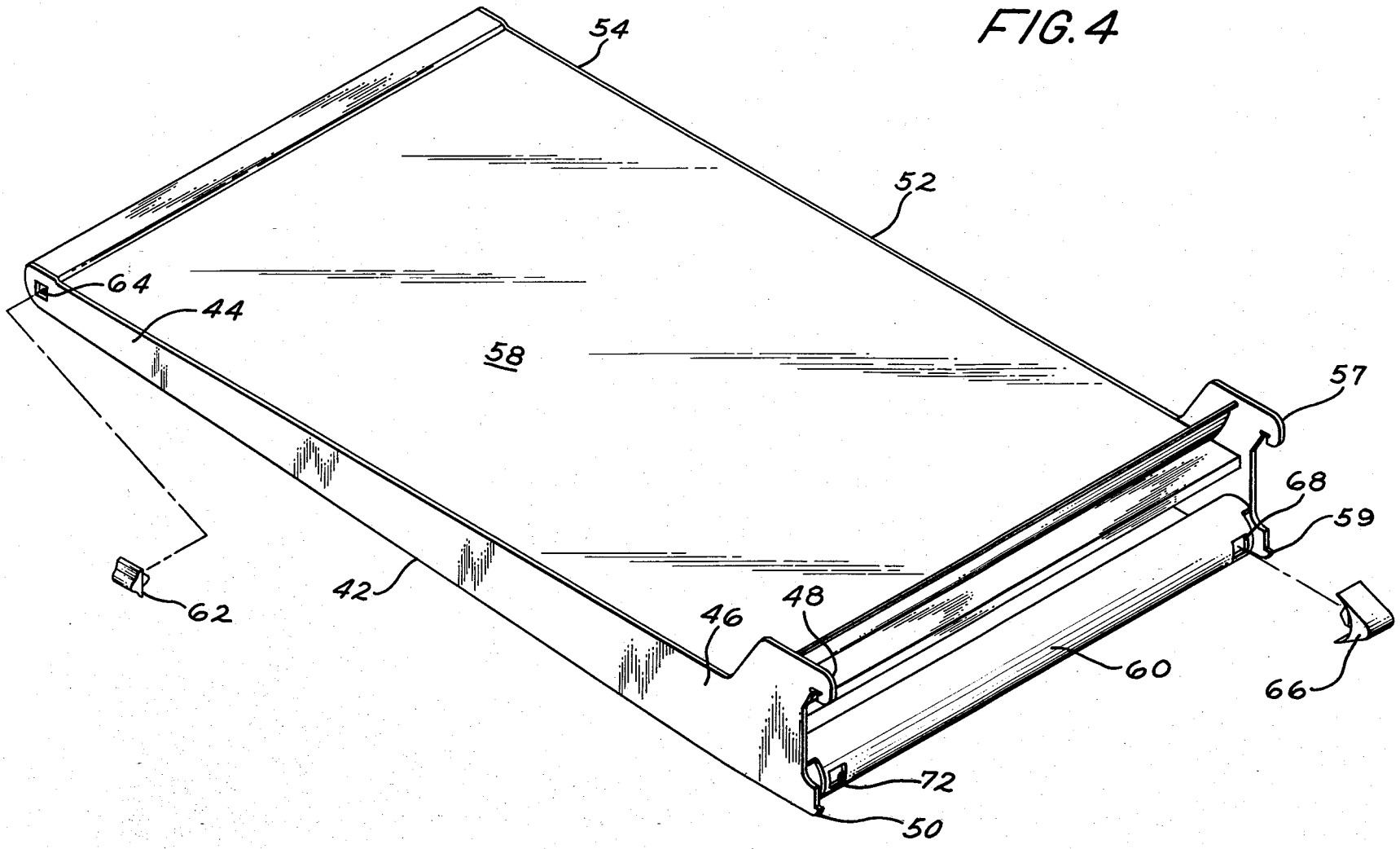
FIG. 4 is a perspective view of the shelf assembly of the support assembly of one embodiment of the present invention.

As shown in FIG. 3, in the preferred embodiment, the elongated tracks 24 are S-shaped, as viewed in lateral cross section and includes two legs 30 and 32 and a connecting middle portion 34. The free terminal end of 36 of leg 30 abuts the rear wall 12 of the cabinet liner and the leg 32 abuts the side wall 14 and is secured thereto by screws 38. The connecting middle portion 34 has a plurality of rectangular slots 40 along the length of each track 24. These slots 40 are for securing the shelves and to accommodate vertical movement of the shelves 16, 18 and 20 which will be discussed later. The tracks 24 may also be U-shaped, as viewed in lateral cross section, and in this case they are secured to the rear wall 12 by screws through the connecting middle portion 34 between the parallel legs. These kind of tracks are often referred to as ladder tracks.

With regard to the half shelf assemblies 18 and 20, there is provided for securement of the shelf assembly to the track 24 a bracket 42 having a forward portion 44 and a rearward portion 46 having means for removable securement to the track 24. In the case of the preferred embodiment of the present invention, the removable securement means includes an upper hook-shaped element 48 which is removably inserted in one of the slots 40 of the track 24. For this purpose, the hook-shaped element 48 is dimensioned to be slightly smaller than the slots 40 so that it may be received therethrough. Also, on the track securing portion 46 of the bracket 42 and located below the hook-shaped element 48 is a tab 50 dimensioned to be slightly smaller than the slots 40 and, therefore, received in one of the slots 40. The tab 50 is utilized to stabilize the bracket 42 when it is engaged in the track 24. With this tab 50, lateral movement of the track securing portion 48 of the bracket 42 is limited and also unintentional upward movement of the track securing portion 48 is prevented. By this arrangement then, to remove the bracket 42 from the track 24, the bracket must be rotated upwardly to pivot about hook-shaped portion 48 and, thus, disengage the tab 50 from the slot 40 in which it is inserted and then remove the hook-shaped element 48 from engagement with the slot 40 in which it is inserted. It will be understood that the bracket 42 may be easily moved up and down along the track 24 and secured to it at whatever elevated position the user desires.

The shelf assembly includes a support member 52 having a forward portion 54 and rearward portion 56 and horizontally spaced from the bracket 42. The support member 52 in the preferred embodiment of my invention also has means, such as upper hook-shaped attachment element 57 and tab 59, for removable securement to a track 24 and this means is of the same configuration and functional operation as the upper hook-shaped attachment element 48 and tab 50 as previously described in connection with the bracket 42. The reason for the bracket 42 and the support member 52 to both have means for removable securement to the tracks 24 is so that the shelf assembly may be utilized on either the right side of the compartment 10 which in FIG. 1 is half shelf 18 or on the left side of compartment 12 which is half shelf 20. Each shelf assembly is therefore arranged to accommodate reverse use.

Between the bracket 42 and the support member 52, there is a planer shelf member 58 which may be made of wire grid, plastic, glass, etc. depending upon the desired structure of the shelf assembly. The planer shelf member 58 is utilized to support stored articles thereon in the compartment 10.

In order for the shelf assembly to wtihstand the forces exerted on the shelf assembly by storing articles thereon, particularly because the shelf assembly is supported on a single track 24, there is provided a torsion member 60 extending between and at right angles to the bracket 42 and support member 52 and secured to each. Preferably, the torsion member 60 is secured to the respective rearward portions 46 and 56 of the bracket 42 and support member 52 as shown in the drawings. The torsion member 60 provides both torsional resistance as well as cantilever support to the shelf assembly. While the torsion member 60 may take various cross-sectional configurations, in the preferred embodiment, the torsion member 60 is hollow and preferably cylindrical in shape. This affords a high resistance to torsion relative to the weight of the torsion member 60. I have found that a cylindrical steel tube welded to the rearward portion 46 of bracket 42 and rearward portion 56 of support member 52 is quite adequate to lend the necessary rigidity to the shelf assembly.

In utilizing the support assembly of the present invention, the shelf assembly is secured to the track 24 by means of the bracket having the hook-shaped element 48 and tab 50 inserted in their respective slots 40 as previously described. The bracket 42 is prevented from horizontal movement by the forward portion 44 abutting the side wall 14 of the compartment 10 adjacent the track 24 secured to that side wall. As a means for stand off of the forward portion 44 of the bracket 42, there is provided a spacer member 62 made of resilient material a portion of which is removably inserted in an opening 64 in the forward portion 44 bracket 42 in frictional engagement therewith. There is also provided another spacer member 66 made of resilient material, a portion of which is removably inserted in an opening 68 in the torsion member 60 in close porximity to the support member 52 and that spacer member 66 abuts the rear wall 12 of the refrigerator compartment 10. A cut out area 63 in the torsion member 60 adjacent bracket 42 is provided so that when the shelf assembly is secured to the track 24, the torsion member 60 bears against the track 24, particularly in the reverse bend area 61 shown in FIG. 3, and lends additonal cantilever support to the shelf assembly. The opposite end of the torsion member 60 also has a cut out area 65 to accommodate reverse use of the shelf assembly.

To accomodate the shelf assembly being usable as either a right hand half shelf such as shown as half shelf 18 in FIG. 1 or as a left hand half shelf as shown as shelf 20, the spacer members 62 and 66 are movable. Spacer member 62 may be removably inserted in the opening 64 of the forward portion 44 of bracket 42 or in an opening 70 in the forward portion 54 of support member 52 depending upon either right hand or left hand use of the shelf assembly. Spacer member 66 may also be removably inserted in opening 68 in the torsion member 60 located close to the support member 52 or in an opening 72 located close to bracket 42 again depending upon either right hand or left hand use of the shelf assembly.

By my invention, there is provided a support assembly that is usable with a single elongated vertical track upon which may be supported half shelf assemblies rigid enough to accommodate the storage of articles thereon.

The foregoing is a description of the preferred embodiment of the invention. In accordance with the patent statutes, changes may be made in the disclosed support assembly without actually departing from the true spirit and scope of the invention as defined in the appended claims.

I claim:

1. A support assembly for an inside corner formed by a vertical rear wall and a vertical side wall intersecting each other at a right angle comprising:

a single elongated vertical track secured to one of the walls in close proximity to the inside corner;

a shelf assembly for securement to only the single track including, a bracket having a forward portion and a rearward portion, said rearward portion having means for removable securement to the track, a support member having a forward portion and a rearward portion and horizontally spaced from the bracket, a planar shelf supported by the bracket and support member; and a torsion member extending between and at a right angle to both the bracket and support member and secured to each at the respective rearward portions thereof.

2. The support assembly of claim 1 wherein the track has spaced slots along the length thereof and the bracket securement means is a hook-shaped attachment means at the rearward portion removably inserted in the slots for support of the shelf assembly.

3. The support assembly of claim 1 wherein there is a spacer member between the forward portion of the bracket and side wall and a spacer member between the rear wall and the end of the torsion member remote from the bracket.

4. The support assembly of claim 1 wherein the torsion member is hollow.

5. The support assembly of claim 4 wherein the hollow torsion member is cylindrical.

6. The support assembly of claim 1 wherein the torsion member has a cut out area adjacent the bracket to cooperate with the track and provide additional cantilever support to the shelf assembly when the bracket is secured to the track.

7. The support assembly of claim 1 wherin the support member has track securement means at the rearward portion for reversibly supporting the shelf assembly by the opposite side of the shelf assembly.

8. The support assembly of claim 7 wherein there is a spacer member between the forward portion of the support member and side wall and a spacer member between the rear wall and the end of the torsion member remote from the support member when the support member is used for securement to the track.

9. The support assembly of claim 6 wherein the torsion member has a cut out area adjacent the support member to cooperate with the track and provide additional cantilever support to the shelf assembly when the support member is secured to the track.

* * * * *